US010800985B2

(12) United States Patent
Patrick et al.

(10) Patent No.: US 10,800,985 B2
(45) **Date of Patent: *Oct. 13, 2020**

(54) PROCESS FOR PRODUCING NAPHTHENIC BRIGHT STOCKS

(71) Applicant: Ergon, Inc., Jackson, MS (US)

(72) Inventors: John K. Patrick, Brandon, MS (US); Howard Don Davis, Ridgeland, MS (US); Edward William Casserly, Madison, MS (US)

(73) Assignee: Ergon, Inc., Jackson, MS (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/687,202

(22) Filed: Nov. 18, 2019

(65) Prior Publication Data

US 2020/0080010 A1 Mar. 12, 2020

Related U.S. Application Data

(63) Continuation of application No. 15/511,496, filed as application No. PCT/US2015/050782 on Sep. 17, 2015, now Pat. No. 10,479,949.

(60) Provisional application No. 62/051,745, filed on Sep. 17, 2014.

(51) Int. Cl.

| | |
|---|---|
| ***C10G 69/08*** | (2006.01) |
| ***C10G 65/12*** | (2006.01) |
| ***C10M 177/00*** | (2006.01) |
| ***C10M 101/02*** | (2006.01) |
| *C10N 70/00* | (2006.01) |

(52) U.S. Cl.

CPC ..... *C10G 69/08* (2013.01); *C10G 65/12* (2013.01); *C10M 101/02* (2013.01); *C10M 177/00* (2013.01); *C10G 2300/202* (2013.01); *C10G 2300/302* (2013.01); *C10G 2300/304* (2013.01); *C10M 2203/1065* (2013.01); *C10M 2203/1085* (2013.01); *C10N 2070/00* (2013.01)

(58) Field of Classification Search

CPC ..... C10G 65/12; C10G 69/08; C10M 101/02; C10M 177/00

See application file for complete search history.

(56) References Cited

U.S. PATENT DOCUMENTS

| | | | |
|---|---|---|---|
| 2,480,628 | A | 8/1949 | Bodkin |
| 3,663,430 | A | 5/1972 | Morris |
| 3,730,876 | A | 5/1973 | Sequeira, Jr. |
| 3,852,207 | A | 12/1974 | Stangeland |

(Continued)

FOREIGN PATENT DOCUMENTS

| | | |
|---|---|---|
| CN | 102066530 | 5/2011 |
| EP | 0287234 | 10/1988 |
| EP | 1997868 A1 | 12/2008 |

OTHER PUBLICATIONS

Application and File History for U.S. Appl. No. 15/511,496, filed Mar. 15, 2017, inventors Patrick et al.

(Continued)

*Primary Examiner* — Brian A McCaig
(74) *Attorney, Agent, or Firm* — Patterson Thuente Pedersen, P.A.

(57) ABSTRACT

A process for producing naphthenic bright stocks from low quality naphthenic crude feedstocks. The naphthenic bright stocks produced by the process have improved low temperature properties at high yields based on feedstock.

22 Claims, 1 Drawing Sheet

(56) References Cited

U.S. PATENT DOCUMENTS

| | | | |
|---|---|---|---|
| 3,993,599 | A | 11/1976 | Mattox |
| 4,100,056 | A | 7/1978 | Reynolds |
| RE30,529 | E | 2/1981 | Reynolds |
| 4,361,477 | A | 11/1982 | Miller |
| 4,421,634 | A | 12/1983 | Olavesen |
| 4,515,680 | A | 5/1985 | Hettinger, Jr. et al. |
| 4,555,352 | A | 11/1985 | Garner et al. |
| 4,657,661 | A | 4/1987 | Miller |
| 4,673,487 | A | 6/1987 | Miller |
| 4,699,707 | A | 10/1987 | Moorehead et al. |
| 4,740,645 | A | 4/1988 | Garwood et al. |
| 4,744,884 | A | 5/1988 | Morehead et al. |
| 4,831,203 | A | 5/1989 | Owen et al. |
| 4,844,826 | A | 7/1989 | Schaefer et al. |
| 4,851,602 | A | 7/1989 | Harandi et al. |
| 4,899,015 | A | 2/1990 | Harandi et al. |
| 4,900,707 | A | 2/1990 | Cody et al. |
| 4,942,021 | A | 7/1990 | Garwood et al. |
| 4,966,680 | A | 10/1990 | Avidan et al. |
| 5,011,902 | A | 4/1991 | Foucht |
| 5,034,565 | A | 7/1991 | Harandi et al. |
| 5,135,638 | A | 8/1992 | Miller |
| 5,282,958 | A | 2/1994 | Santini et al. |
| 5,804,058 | A | 9/1998 | Grandvallet et al. |
| 5,840,175 | A | 11/1998 | Aldous et al. |
| 5,846,405 | A | 12/1998 | Aldous et al. |
| 5,853,569 | A | 12/1998 | Aldous et al. |
| 5,976,354 | A | 11/1999 | Powers et al. |
| 6,024,864 | A | 2/2000 | Aldous et al. |
| 6,080,302 | A | 7/2000 | Aldous et al. |
| 6,294,077 | B1 | 9/2001 | Dougherty et al. |
| 6,337,010 | B1 | 1/2002 | Hofer |
| 6,383,366 | B1 | 5/2002 | Riley et al. |
| 6,576,120 | B1 | 6/2003 | Van Ballegoy et al. |
| 7,179,365 | B2 | 2/2007 | Aldous et al. |
| 7,261,808 | B2 | 8/2007 | Grandvallet et al. |
| 7,638,037 | B2 | 12/2009 | Benard et al. |
| 7,776,206 | B2 | 8/2010 | Miller et al. |
| 8,585,889 | B2 | 11/2013 | Kim et al. |
| 8,691,076 | B2 | 4/2014 | Kim et al. |
| 8,911,613 | B2 | 12/2014 | Noh et al. |
| 10,479,949 | B2 * | 11/2019 | Patrick ..... C10G 69/08 |
| 2002/0193649 | A1 | 12/2002 | O'Rear et al. |
| 2005/0006282 | A1 | 1/2005 | Grandvallet |
| 2005/0051463 | A1 | 3/2005 | Miller et al. |
| 2005/0272850 | A1 | 12/2005 | Jois et al. |
| 2007/0090016 | A1 | 4/2007 | Patrick et al. |
| 2007/0175794 | A1 | 8/2007 | Duininck et al. |
| 2007/0238628 | A1 | 10/2007 | Haire et al. |
| 2007/0283718 | A1 | 12/2007 | Hulsey et al. |
| 2009/0166252 | A1 | 7/2009 | Daage et al. |
| 2013/0048537 | A1 | 2/2013 | Noh et al. |
| 2017/0283719 | A1 | 10/2017 | Patrick et al. |

OTHER PUBLICATIONS

Application and File History for U.S. Appl. No. 15/511,442, filed Mar. 15, 2017, inventors Patrick et al.

Chinese First Office Action dated May 15, 2018, for Chinese Application No. 201580050079.1. English translation provided.

European Patent Communication dated Mar. 19, 2018, for European Application No. 15771442.9-1101.

Chinese First Office Action for Chinese Application No. 201580050635.5 dated Jun. 12, 2018. English translation provided.

Examination Report for related EP Application No. 15771440.3 dated Jan. 16, 2018; 8 pages.

International Search Report for corresponding International Application No. PCT/US2015/050782 dated Nov. 25, 2015; 4 pages.

Written Opinion of the International Searching Authority for corresponding International Application No. PCT/US2015/050782 dated Nov. 25, 2015; 6 pages.

International Search Report for related International Application No. PCT/US2015/050770 dated Nov. 25, 2015; 4 pages.

Written Opinion of the International Searching Authority for related International Application No. PCT/US2015/050770 dated Nov. 25, 2015; 8 pages.

Süd-Chemie, "HYDEX® Hydrodewaxing Catalysts," (2001); 20 pages.

Criterion Catalysts for Improved Lubricating Oil (2012); 2 pages. Retrieved online at http://www.criterioncatalysts.com/content/dam/shell/static/criterion/downloads/pdf/fact-sheets/lube-oik-factsheethires.pdf.

Non-Final Office for related U.S. Appl. No. 15/511,442 dated Dec. 19, 2017; 14 pages.

* cited by examiner

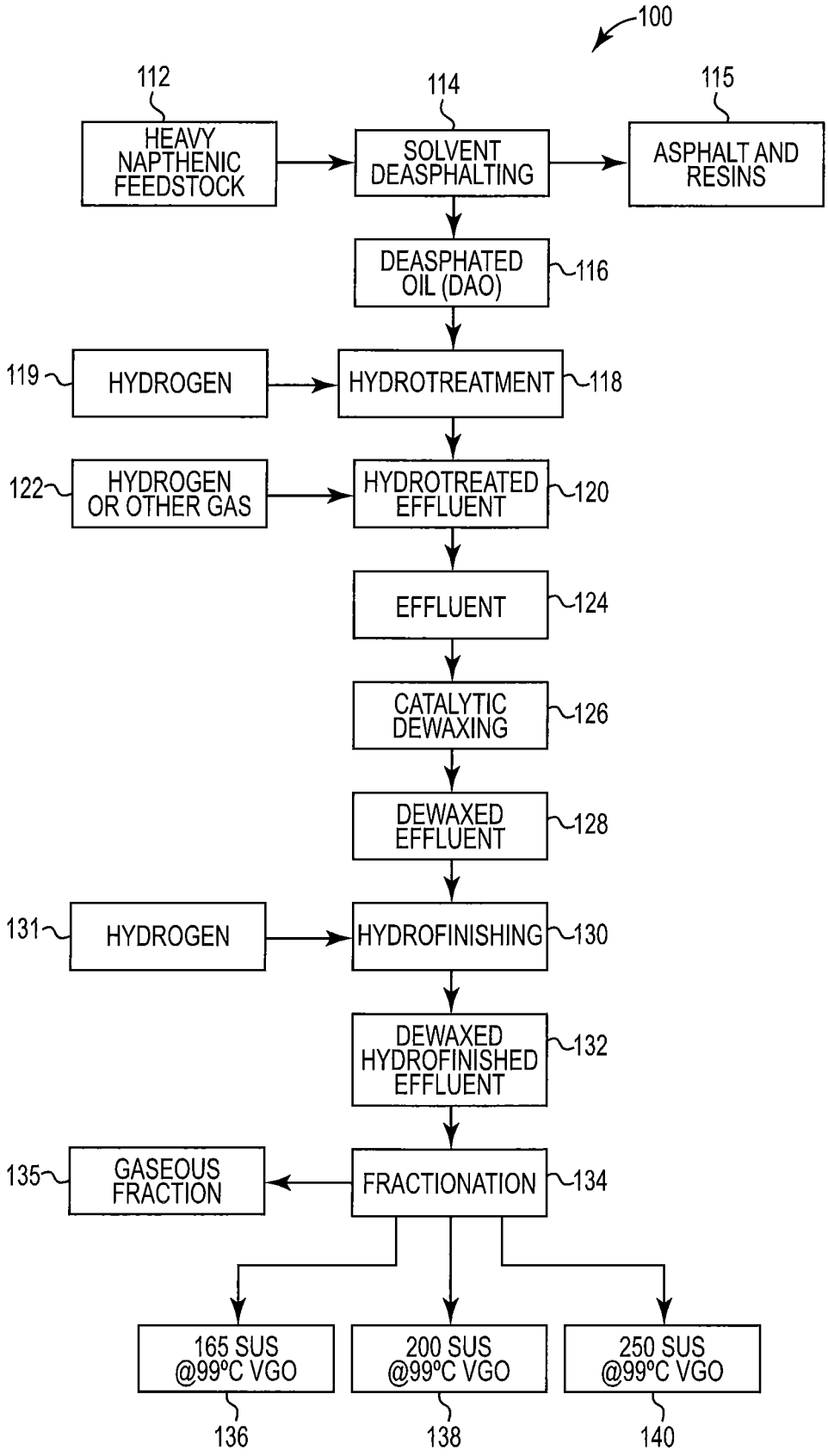
100
112
HEAVY NAPTHENIC FEEDSTOCK
114
SOLVENT DEASPHALTING
115
ASPHALT AND RESINS
DEASPHATED OIL (DAO)
116
119
HYDROGEN
HYDROTREATMENT
118
122
HYDROGEN OR OTHER GAS
HYDROTREATED EFFLUENT
120
EFFLUENT
124
CATALYTIC DEWAXING
126
DEWAXED EFFLUENT
128
131
HYDROGEN
HYDROFINISHING
130
DEWAXED HYDROFINISHED EFFLUENT
132
135
GASEOUS FRACTION
FRACTIONATION
134
165 SUS @99°C VGO
200 SUS @99°C VGO
250 SUS @99°C VGO
136
138
140

PROCESS FOR PRODUCING NAPHTHENIC BRIGHT STOCKS

RELATED APPLICATIONS

This application is a continuation of application Ser. No. 15/511,496 filed Mar. 15, 2017, which is a National Phase entry of PCT Application No. PCT/US2015/050782, filed Sep. 17, 2015, which claims priority from U.S. Provisional Patent Application No. 62/051,745, filed Sep. 17, 2014, each of which is hereby fully incorporated herein by reference.

TECHNICAL FIELD

This invention relates to a process for the manufacture of naphthenic bright stocks.

BACKGROUND

Bright stocks are made from petroleum feedstocks that have been solvent deasphalted and then solvent refined or hydrotreated to provide a modified oil having improved cleanliness or quality. Bright stocks typically are classified as either naphthenic or paraffinic. The production of quality naphthenic bright stocks requires careful selection of processing steps in order to meet target performance characteristics and production costs.

SUMMARY OF THE INVENTION

Some potential feedstocks for making naphthenic bright stocks contain undesirably high levels of wax or wax-like molecules. Processing such feedstocks may result in unacceptably low final product yields. The present invention provides a process for producing naphthenic bright stocks having desirable properties such as low pour points, low cloud points, environmentally friendly characteristics and the ability to satisfy applicable specifications. The disclosed process can employ a variety of feedstocks including naphthenic crude oils, blends of naphthenic and paraffinic crude oils, or blends of naphthenic crude oils and other feedstocks while providing desirable final product properties and yields.

The present invention provides, in one aspect, a process for producing a naphthenic bright stock comprising the steps of:

a) dewaxing a hydrotreated deasphalted naphthenic oil having a sulfur content of up to about 0.5% by weight (as measured by ASTM D4294) and a nitrogen content of up to about 0.1% by weight (as measured by ASTM D5762) in the presence of a dewaxing cracking catalyst and under catalytic dewaxing conditions to produce a dewaxed effluent;

b) hydrofinishing the dewaxed effluent to produce a dewaxed hydrofinished effluent having reduced levels of polycyclic aromatic hydrocarbons (PAH compounds, also known as polycyclic aromatics or PCA) and unstable olefinic compounds; and c) fractionating the dewaxed effluent to remove one or more low viscosity high volatility fractions and provide a naphthenic bright stock having a pour point (as measured by ASTM D5949) reduced by 10° C. compared to that of the deasphalted naphthenic oil, at a yield greater than 85% of total naphthenic bright stock over total deasphalted naphthenic oil.

The present invention provides, in another aspect, a naphthenic bright stock having an aniline point (as measured by ASTM D611) of about 100° C. to about 140° C., a flash point (as measured using a Cleveland Open Cup and ASTM D92) of about 188° C. to about 409° C., a viscosity index (VI) greater than 75, a viscosity (SUS at 98.9° C.) of about 165 to about 250, and a pour point (as measured using ASTM D5950) about 42° C. to about −39° C.

The disclosed process can expand the potential feedstock selection and improve desired qualities of the finished naphthenic bright stock without unduly adversely affecting yields.

BRIEF DESCRIPTION OF THE DRAWING

FIG. 1 is a schematic diagram illustrating one embodiment of the disclosed method.

Like reference symbols in the various FIGURES of the drawing indicate like elements.

DETAILED DESCRIPTION

Numerical ranges expressed using endpoints include all numbers subsumed within that range (e.g., 1 to 5 includes 1, 1.5, 2, 2.75, 3, 3.80, 4 and 5). All percentages are weight percentages unless otherwise stated.

The term "30-markers" when used with respect to a feedstock, process stream or product refers to the total quantity of the PAH compounds acenaphthene (ACE, CAS No. 83-32-9), acenaphthylene (ACY, CAS No. 208-96-8), anthanthrene (ANT, CAS No. 191-26-4), anthracene (ANTH, CAS No. 120-12-7), benzo(a)anthracene (BaA, CAS No. 56-55-3), benzo(a)pyrene (BaP, CAS No. 50-32-8), benzo(b)fluoranthene (BbFA, CAS No. 205-99-2), benzo(b)naphtho[1,2-d]thiophene (BNT, CAS No. 205-43-6), benzo(e)pyrene (BeP, CAS No. 192-97-2), benzo(ghi)fluoranthene (BghiF, CAS No. 203-12-3), benzo(ghi)perylene (BGI, CAS No. 191-24-2), benzo(j)fluoranthene (BjFA, CAS No. 205-82-3), benzo(k)fluoranthene (BkFA, CAS No. 207-08-9), benzo[c]phenanthrene (BcP, CAS No. 195-19-7), chrysene (CHR, CAS No. 218-01-9), coronene (COR, CAS No. 191-07-1), cyclopenta(c,d)pyrene (CPP, CAS No. 27208-37-3), dibenzo(a,e)pyrene (DBaeP, CAS No. 192-65-4), dibenzo(a,h)anthracene (DBAhA, CAS No. 53-70-3), dibenzo(a,h)pyrene (DBahP, CAS No. 189-64-0), dibenzo(a,i)pyrene (DBaiP, CAS No. 189-55-9), dibenzo(a,l)pyrene (DBalP, CAS No. 191-30-0), fluoranthene (FLA, CAS No. 206-44-0), fluorene (FLU, CAS No. 86-73-7), indeno[123-cd]pyrene (IP, CAS No. 193-39-5), naphthalene (NAP, CAS No. 91-20-3), perylene (PERY, CAS No. 198-55-0), phenanthrene (PHN, CAS No. 85-01-8), pyrene (PYR, CAS No. 129-00-0) and triphenylene (TRIP, CAS No. 217-59-4) in such feedstock, process stream or product. The term "22-markers" refers to a subset of the 30-markers PAH compounds, namely the PAH compounds acenaphthene, acenaphthylene, anthracene, benzo(a)anthracene, benzo(a)pyrene, benzo(b)fluoranthene, benzo(e)pyrene, benzo(ghi)perylene, benzo(j)fluoranthene, benzo(k)fluoranthene, chrysene, dibenzo(a,e)pyrene, dibenzo(a,h)anthracene, dibenzo(a,h)pyrene, dibenzo(a,i)pyrene, dibenzo(a,l)pyrene, fluoranthene, fluorene, indeno[123-cd]pyrene, naphthalene, phenanthrene and pyrene. The term "18-markers" refers to another subset of the 30-markers PAH compounds, namely the PAH compounds acenaphthene, acenaphthylene, anthracene, benzo(a)anthracene, benzo(a)pyrene, benzo(b)fluoranthene, benzo(e)pyrene, benzo(ghi)perylene, benzo(j)fluoranthene, benzo(k)fluoranthene, chrysene, dibenzo(a,h)anthracene, fluoranthene, fluorene, indeno[123-cd]pyrene, naphthalene, phenanthrene and pyrene. The term "16-markers" refers to yet another subset of the 30-markers PAH compounds, namely the PAH compounds acenaphthene, acenaphthylene, anthracene, benzo(a)anthracene, benzo(a)pyrene, benzo(b)fluoranthene, benzo(ghi)perylene, benzo(k)fluoranthene, chrysene, dibenzo(a,h)anthracene, fluoranthene, fluorene, indeno[123-cd]pyrene, naphthalene, phenanthrene and pyrene. The term "8-markers" refers to a further subset of the 30-markers PAH compounds, namely the compounds benzo(a)anthracene, benzo(a)pyrene, benzo(b)fluoranthene, benzo(e)pyrene, benzo(j)fluoranthene, benzo(k)fluoranthene, chrysene, and dibenzo(a,h)anthracene. Limits of 10 ppm for the sum of the 8-markers, and 1 ppm for benzo[a]pyrene are set forth in European Union Directive 2005/69/EC of the European Parliament and of the Council of 16 Nov. 2005. Industry and regulators have not yet set limits for 16-markers, 18-markers, 22-markers or 30 markers.

The term "aromatic" when used with respect to a feedstock, process stream or product refers to a liquid material having a viscosity-gravity constant (VGC) close to 1 (e.g., greater than about 0.95) as determined by ASTM D2501. Aromatic feedstocks or process streams typically will contain at least about 10% $C_A$ content and less than about 90% total $C_P$ plus $C_N$ content as measured according to ASTM D2140.

The term "ASTM" refers to the American Society for Testing and Materials which develops and publishes international and voluntary consensus standards. Exemplary ASTM test methods are set out below. However, persons having ordinary skill in the art will recognize that standards from other internationally recognized organizations will also be acceptable and may be used in place of or in addition to ASTM standards.

The term "hydrocracking" refers to a process in which a feedstock or process stream is reacted with hydrogen in the presence of a catalyst at very high temperatures and pressures, so as to crack and saturate the majority of the aromatic hydrocarbons present and eliminate all or nearly all sulfur-, nitrogen- and oxygen-containing compounds.

The term "hydrofinishing" refers to a process in which a feedstock or process stream is reacted with hydrogen in the presence of a catalyst under less severe conditions than for hydrotreating or hydrocracking, so as to reduce the levels of PAH compounds and stabilize (e.g., reduce the levels of) otherwise unstable molecules such as olefinic compounds. Hydrofinishing may for example be used following hydrocracking to improve the color stability and stability towards oxidation of a hydrocracked product.

The term "hydrogenated" when used with respect to a feedstock, process stream or product refers to a material that has been hydrofinished, hydrotreated, reacted with hydrogen in the presence of a catalyst or otherwise subjected to a treatment process that materially increases the bound hydrogen content of the feedstock, process stream or product.

The term "hydrotreating" refers to a process in which a feedstock or process stream is reacted with hydrogen in the presence of a catalyst under more severe conditions than for hydrofinishing and under less severe conditions than for hydrocracking, so as to reduce unsaturation (e.g., aromatics) and reduce the amounts of sulfur-, nitrogen- or oxygen-containing compounds.

The term "liquid yield" when used with respect to a process stream or product refers to the weight percent of liquid products collected based on the starting liquid material amount.

The term "lube yield" when used with respect to a distillation process stream or product refers to a value estimated from the distillation curve and representing the percent of liquid material boiling above a target volatility specification (for example, distillation temperature or flash point) for a specific market application.

The term "naphthenic" when used with respect to a feedstock, process stream or product refers to a liquid material having a VGC from about 0.85 to about 0.95 as determined by ASTM D2501. Naphthenic feedstocks typically will contain at least about 30% $C_N$ content and less than about 70% total $C_P$ plus $C_A$ content as measured according to ASTM D2140.

The term "naphthenic bright stock" refers to a dewaxed, deasphalted naphthenic oil having a viscosity index between 70 and 95, for example greater than 80 and less than 95, as determined by ASTM D2270. If not otherwise specified below, the term "bright stock" refers to a naphthenic bright stock.

The term "paraffinic" when used with respect to a feedstock, process stream or product refers to a liquid material having a VGC near 0.8 (e.g., less than 0.85) as determined by ASTM D2501. Paraffinic feedstocks typically will contain at least about 60 wt. % $C_P$ content and less than about 40 wt. % total $C_N$+$C_A$ content as measured according to ASTM D2140.

The terms "Viscosity-Gravity Constant" or "VGC" refer to an index for the approximate characterization of the viscous fractions of petroleum. VGC is defined as the general relation between specific gravity and Saybolt Universal viscosity, and may be determined according to ASTM D2501. VGC is relatively insensitive to molecular weight.

The term "viscosity" when used with respect to a feedstock, process stream or product refers to the kinematic viscosity of a liquid. Kinematic viscosities typically are expressed in units of $mm^2/s$ or centistokes (cSt), and may be determined according to ASTM D445. Historically the petroleum industry has measured kinematic viscosities in units of Saybolt Universal Seconds (SUS). Viscosities at different temperatures may be calculated according to ASTM D341 and may be converted from cSt to SUS according to ASTM D2161.

The processing scheme for a paraffinic bright stock may for example involve various processes and combinations of processes including crude distillation, solvent de-asphalting, catalytic dewaxing, hydrofinishing and fractionation. In some instances a hydrotreating step may be included. Naphthenic bright stock may for example be produced by distillation of naphthenic crude, solvent de-asphalting of the vacuum tower bottoms to produce a de-asphalted oil (DAO), and hydrotreatment of the DAO to produce the finished naphthenic bright stock product. Even if derived from a wax-free crude oil, the high molecular weight components of the naphthenic bright stock may contain sufficient normal paraffin or other wax-like constituents to create a visual haze in the finished product or higher than desired pour points and cloud points.

Additional processing steps may optionally be employed before or after the steps mentioned above. Exemplary such steps include solvent extraction, solvent dewaxing and hydrocracking. In some embodiments no additional processing steps are employed, and in other embodiments additional processing steps such as any or all of solvent extraction, solvent dewaxing and hydrocracking are not required or are not employed.

Referring to FIG. 1, a method for producing naphthenic bright stock is shown in schematic form. Steps 100 include treating a heavy naphthenic feedstock 112 containing high levels of sulfur-containing or nitrogen-containing compounds by solvent de-asphalting 114 to separate oil from asphalt and resins 115 and produce a de-asphalted oil (DAO) fraction 116. DAO fraction 116 is hydrotreated 118 with a stream of hydrogen 119 to produce a hydrotreated effluent 120. Hydrotreated effluent 120 is contacted with a stream 122 of hydrogen or other gas at elevated temperatures for a sufficient time period to remove at least some of the sulfur or nitrogen compounds and produce effluent 124. Effluent 124 is catalytically dewaxed 126 to remove or convert waxes and wax-like compounds and produce dewaxed effluent 128. Effluent 128 is hydrofinished 130 with a stream of hydrogen 131 to stabilize any olefinic or unstable compounds that were created during the dewaxing step and produce dewaxed hydrofinished effluent 132. Effluent 132 is fractionated 134 to separate it into one or more gaseous fractions 135 and one or more liquid fractions. e.g., one or more of the 165, 200 or 250 SUS@99° C. (210° F.) vacuum gas oils 136, 138 or 140.

The disclosed process can employ a variety of deasphalted naphthenic feedstocks, including deasphalted naphthenic crudes, deasphalted waxy naphthenic crudes, deasphalted naphthenic distillates (including lube, atmospheric and vacuum distillates), mixtures thereof, and deasphalted blends of naphthenic crude, waxy naphthenic crude or a naphthenic distillate with amounts (e.g., lesser or major amounts) of other petroleum-based or synthetic materials including paraffinic feedstocks, paraffinic distillates (including lube, atmospheric and vacuum distillates), light or heavy cycle oil (coker gas oil), deasphalted oil (DAO), cracker residues, hydrocarbon feedstocks containing heteroatom species and aromatics and boiling at about 150° C. to about 550° C. (as measured by ASTM D7169), and mixtures thereof. The disclosed process may be used with feedstocks containing major portions (e.g., more than 50 wt. %) of DAOs containing substantial amounts of sulfur- and nitrogen-containing compounds. Suitable DAO fractions include deasphalted atmospheric residues, deasphalted vacuum residues or both. The disclosed process is particularly suited for use with heavy naphthenic feedstocks containing high levels of sulfur-containing or nitrogen-containing compounds and less than about 15 wt. % wax, and where production of a high viscosity boiling range distillate fraction product is desired. The boiling range of such vacuum distillate fractions may for example be between about 300° and about 790° C. or between about 350° C. and about 750° C.

The chosen feedstock may contain sulfur levels up to about 5% by weight (viz., up to about 50,000 ppm) as determined by ASTM D4294, and nitrogen levels up to about 3% by weight (viz., up to about 30,000 ppm) as determined by ASTM D5762. Such nitrogen and sulfur levels allow retention or attainment of desirable properties in the finished product such as viscosity, aniline point, solvency and bright stock yield.

If not already done, the feedstock is deasphalted to separate oil from asphalt and resins, using techniques that will be familiar to persons having ordinary skill in the art. The feedstock may for example be contacted with a suitable solvent at temperatures and pressures adequate for precipitating asphalt and resin fractions that are not soluble in the solvent. Factors such as the temperature and solvent-to-feed ratio can be varied to obtain deasphalted oil at a desired yield.

The deasphalted feedstock (e.g. a DAO or other sulfur or nitrogen-containing feedstock) is hydrotreated using techniques that will be familiar to persons having ordinary skill in the art. The primary purpose of hydrotreating is to remove sulfur, nitrogen and polar compounds and to saturate some aromatic compounds. The hydrotreating step thus produces a first stage effluent or hydrotreated effluent having at least a portion of the aromatics present in the feedstock converted to their saturated analogs, and the concentration of sulfur- or nitrogen-containing heteroatom compounds decreased. The hydrotreating step may be carried out by contacting the feedstock with a hydrotreating catalyst in the presence of hydrogen under suitable hydrotreating conditions, using any suitable reactor configuration. Exemplary reactor configurations include a fixed catalyst bed, fluidized catalyst bed, moving bed, slurry bed, counter current, and transfer flow catalyst bed.

The hydrotreating catalyst is used in the hydrotreating step to remove sulfur and nitrogen and typically includes a hydrogenation metal on a suitable catalyst support. The hydrogenation metal may include at least one metal selected from Group 6 and Groups 8-10 of the Periodic Table (based on the IUPAC Periodic Table format having Groups from 1 to 18). The metal will generally be present in the catalyst composition in the form of an oxide or sulfide. Exemplary metals are iron, cobalt, nickel, tungsten, molybdenum, chromium and platinum. Particularly desirable metals are cobalt, nickel, molybdenum and tungsten. The support may be a refractory metal oxide, for example, alumina, silica or silica-alumina Exemplary commercially available hydrotreating catalysts include LH-23, DN-200, DN-3330, and DN-3620 from Criterion. Companies such as Albemarle, Axens, Haldor Topsoe, and Advanced Refining Technologies also market similar catalysts.

The temperature in the hydrotreating step typically may be about 260° C. (500° F.) to about 399° C. (750° F.), about 287° C. (550° F.) to about 385° C. (725° F.), or about 307° C. (585° F.) to about 351° C. (665° F.). Exemplary hydrogen pressures that may be used in the hydrotreating stage typically may be about 5,515 kPa (800 psig) to about 27,579 kPa (4,000 psig), about 8,273 kPa (1,200 psig) to about 22,063 kPa (3,200 psig), or about 11,721 kPa (1700 psig) to about 20,684 kPa (3,000 psig). The quantity of hydrogen used to contact the feedstock may typically be about 17.8 to about 1,780 $m^3/m^3$ (about 100 to about 10,000 standard cubic feet per barrel (scf/B)) of the feedstock stream, about 53.4 to about 890.5 $m^3/m^3$ (about 300 to about 5,000 scf/B) or about 89.1 to about 623.4 $m^3/m^3$ (500 to about 3,500 scf/B). Exemplary reaction times between the hydrotreating catalyst and the feedstock may be chosen so as to provide a liquid hourly space velocity (LHSV) of about 0.25 to about 5 cc of oil per cc of catalyst per hour ($hr^{-1}$), about 0.35 to about 1.5 $hr^{-1}$, or about 0.5 to about 0.75 $hr^{-1}$.

The reactor effluent may include sulfur- and nitrogen-containing gases (e.g., ammonia and hydrogen sulfide) produced in the hydrotreating step. The amounts of such gases may be reduced, for example to help protect the dewaxing cracking catalyst from becoming poisoned, improve the activity of or prolong the life of the dewaxing cracking catalyst, or to lessen the amount of dewaxing cracking catalyst required for the disclosed process. Reduced ammonia and hydrogen sulfide content may be achieved by contacting the hydrotreated effluent with a stream of hydrogen (or other gas) at elevated temperatures for a sufficient time period to remove at least some of the nitrogen or sulfur compounds. The gas stream preferably is predominantly hydrogen (e.g., greater than 50% by volume).

Hydrotreating may be followed by a catalytic dewaxing step. In this step, the dewaxing cracking catalyst reduces (e.g., by converting) the amount of waxes (e.g., hydrocarbons which solidify easily) or wax-like components present in the feedstock or the hydrotreated effluent. Such waxes and wax-like components, when present, are capable of adversely affecting cold-flow properties such as pour points and cloud points. Waxes may include high temperature melting paraffins, isoparaffins and monocyclic compounds such as naphthenic compounds having alkyl side chains.

The dewaxing cracking catalyst may be any catalyst suitable for cracking (viz., breaking down) large hydrocarbon molecules into smaller molecules in the presence of hydrogen and reducing the pour point of the hydrotreated effluent. Cracking catalysts may be distinguished from isomerization catalysts which primarily rearrange molecules rather than cracking large molecules into smaller molecules. Dewaxing catalysts that tolerate feedstock contaminants or catalyst poisons and have a high selectivity to cracking of waxy n-paraffins are preferred. For example, the dewaxing catalyst should tolerate hydrotreated effluents containing up to about to 0.5% by weight sulfur as determined by ASTM D4294 (viz., up to about 5000 ppm) and up to about 0.1% by weight nitrogen as determined by ASTM D5762 (viz., up to about 1000 ppm). In some embodiments, the catalyst is tolerant to hydrotreated effluents containing about 0.01 to about 0.15 wt. % sulfur. In other embodiments, the catalyst is tolerant to hydrotreated effluents containing about 0.01 to about 0.1 wt. % nitrogen. Removal of higher levels of sulfur and nitrogen from the hydrotreated effluent may require more severe process conditions (e.g., hydrocracking at temperatures above 700° C.), resulting in reduced solvency of the finished product and lower yields. The disclosed process allows for retention of or improvement in desirable solvency characteristics of the naphthenic feedstock while reducing or minimizing yield loss.

Exemplary dewaxing cracking catalysts include heterogeneous catalysts having a molecular sieve and metallic functionality that provides hydrogenation catalyzation. Examples include medium pore molecular sieve zeolite catalysts having a 10-membered oxygen ring such as catalysts with a ZSM-5 designation. The metal used in the dewaxing catalyst desirably is a metal having hydrogenation activity selected from among Group 2, 6, 8, 9 and 10 metals of the periodic table. Preferred metals include Co and Ni among Group 9 and 10 metals, and Mo and W among Group 6 metals.

Exemplary other dewaxing cracking catalysts include synthetic and natural faujasites (e.g., zeolite X and zeolite Y), erionites, and mordenites. They may also be composited with purely synthetic zeolites such as those of the ZSM series. A combination of zeolites can also be composited in a porous inorganic matrix. Exemplary such catalysts include metal-impregnated dual functional mordenite framework inverted (MFI) type zeolite metal loaded catalysts. In some embodiments, the MFI type zeolite metal loaded catalyst desirably has a 1.5 mm (1/16") or 2.5 mm (1/10") particle size. Exemplary commercially available dewaxing cracking catalysts include those sold under the trademark HYDEX™ (e.g. HYDEX L, G and C) by Clariant as well as various zeolite catalysts sold by Albemarle (e.g. KF-1102).

The dewaxing cracking catalyst may be amorphous. Exemplary amorphous dewaxing cracking catalysts include alumina, fluorided alumina, silica-alumina, fluorided silica-alumina and silica-alumina doped with Group 3 metals. Such catalysts are described in, for example, U.S. Pat. Nos. 4,900,707 and 6,383,366, both of which are incorporated herein by reference.

Dewaxing conditions typically include temperatures of about 260° C. (500° F.) to about 399° C. (750° F.), about 287° C. (550° F.) to about 371° C. (700° F.), or about 301° C. (575° F.) to about 343° C. (650° F.), and pressures of about 5,515 kPa (800 psig) to about 27,579 kPa (4000 psig), about 5,515 kPa (800 psig) to about 22,063 kPa (3200 psig), or about 8,273 kPa (1200 psig) to about 20,684 kPa (3000 psig). The liquid hourly space velocities may range from about 0.25 to about 7 $hr^{-1}$, about 1 to about 5 $hr^{-1}$; or about 1.5 to about 2 $hr^{-1}$ and hydrogen treat gas rates may range from about 45 to about 1780 $m^3/m^3$ (250 to 10,000 scf/B), preferably about 89 to about 890 $m^3/m^3$ (500 to 5,000 scf/B).

The disclosed process has been found to be particularly suitable for the preparation of bright stocks from a naphthenic feedstock containing between about 0.5 wt. % and 15 wt. %, or about 2 wt. % to about 10 wt. %, or about 1 wt. % to about 8 wt. % waxy compounds in the total feedstock. The dewaxed effluent desirably has a pour point reduced by at least 10° C. or by at least 20° C. compared to that of the naphthenic feedstock, for example a pour point below about −5° C., below about −10° C. or below about −15° C. The dewaxed effluent also desirably has a cloud point reduced by at least 10° C. compared to that of the naphthenic feedstock.

The disclosed process desirably includes dewaxing catalyst regeneration if the catalyst activity has been reduced, for example due to coking, sulfur poisoning, or nitrogen poisoning. Regeneration can for example be conducted in-situ using a hot hydrogen strip of the catalyst at a temperature ranging from about 357° C. (675° F.) to about 399° C. (750° F.) for a period of between 4 hrs and 12 hrs.

The product obtained in the catalytic dewaxing process is also subjected to a hydrofinishing step. The primary purpose of this step is to stabilize any olefinic or unstable compounds that were created during the dewaxing step, improving oxidation and color stability. Hydrofinishing may also advantageously decrease the remaining aromatic content, and in particular any PAH compounds left in the dewaxed effluent, so that the bright stock thus obtained will be able to meet specific PAH standards. In addition to control of specific PAH compounds, the hydrofinishing step may also enable better control over aniline point, refractive index, aromatic/naphthenic ratio, or other direct or indirect measurements of solvency.

Exemplary hydrofinishing catalysts include catalysts like those discussed above in connection with hydrotreating, for example nickel, molybdenum, cobalt, tungsten, platinum and combinations thereof. The hydrofinishing catalyst may also be incorporated into a multi-functional (for example, bifunctional) dewaxing catalyst. A bifunctional dewaxing catalyst will have both a dewaxing function and a hydrogenation function. The hydrogenation function is preferably provided by at least one Group 6 metal, at least one Group 8-10 metal, or mixtures thereof. Desirable metals include Group 9-10 metals (for example, Group 9-10 noble metals) such as Pt, Pd or mixtures thereof. These metals may for example be present in an amount of about 0.1 to 30 wt. %, about 0.1 to about 10 wt. %, or about 0.1 to about 5 wt. %, based on the total weight of the catalyst. Catalyst preparation and metal loading methods are described for example in U.S. Pat. No. 6,294,077, which is incorporated herein by reference, and include, for example, ion exchange and impregnation using decomposable metal salts. Metal dispersion techniques and catalyst particle size control are described for example in U.S. Pat. No. 5,282,958, which is also incorporated herein by reference. Catalysts with small particle size and well-dispersed metals are preferred.

Hydrofinishing conditions normally involve operating temperatures of from about 260° C. (500° F.) to about 399° C. (750° F.), about 287° C. (550° F.) to about 371° C. (700° F.), or about 301° C. (575° F.) to about 329° C. (625° F.); and pressures from about 5,515 kPa (800 psig) to about 27,579 kPa (4000 psig), about 5,515 kPa (800 psig) to about 22,063 kPa (3,200 psig), or about 8,273 kPa (1200 psig) to about 20,684 kPa (3,000 psig). Liquid hourly space velocities may for example be about 0.25 to about 5 $hr^{-1}$, about 1 to about 4 $hr^{-1}$; or about 2 to about 2.5 $hr^{-1}$.

The dewaxing and hydrofinishing steps may if desired be carried out in separate reactors. Desirably the dewaxing and hydrofinishing steps take place sequentially in the same reaction vessel. Doing so may improve operations and reduce capital cost requirements.

The dewaxed hydrofinished effluent is fractionated to separate it into one or more gaseous fractions and one or more liquid fractions. Fractionation may be performed using methods that will be familiar to persons having ordinary skill in the art, such as distillation under atmospheric or reduced pressure. Distillation under reduced pressure (for example vacuum flashing and vacuum distillation) is preferred. The cutpoints of the distillate fractions preferably are selected such that each product distillate recovered has the desired properties for its envisaged application. For bright stocks, the initial boiling point will normally be for example at least 425° C. and will normally not exceed 725° C., the exact cutpoint being determined by the desired product properties, such as volatility, viscosity, viscosity index and pour point.

Naphthenic bright stocks obtained using the disclosed process have good solvency for use in industries such as rubber and chemical processing and may be used as a blend component to provide or replace lube products in a desired viscosity range.

The disclosed process may provide bright stocks that have the following desirable characteristics separately or in combination: an aniline point (ASTM D611) of about 100° C. to about 140° C. or about 115° C. to about 120° C.; a flash point (Cleveland Open Cup, ASTM D92) of at least about 188° C. to about 409° C., or of at least about 245° C. to about 355° C.; a viscosity index (VI) of greater than 75, greater than 80 or greater than 90; a viscosity (SUS at 98.9° C.) in the range of about 165 to about 250; pour points (° C., ASTM D5950) in the range of about 42° C. to about −39° C. or from about 12° C. to about −9° C.; and yields that are greater than greater than 85 vol. %, e.g., greater than about 90%, or about 97% to about 99% of total bright stock yield based on feedstock.

Other desirable characteristics for the disclosed base oils may include compliance with environmental standards such as EU Directive 2005/69/EC, IP346 and Modified AMES testing ASTM E1687, to evaluate whether the finished product may be carcinogenic. These tests correlate with the concentration of PAH compounds. Desirably, the disclosed base oils have less than 8 ppm, more desirably less than 2 ppm and most desirably less than 1 ppm of the sum of the 8-markers when evaluated according to European standard EN 16143:2013. The latter values represent especially noteworthy 8-markers scores, and represent up to an order of magnitude improvement beyond the EU regulatory requirement. Although as noted above industry and regulators have not yet set standards for desired amounts of 16-markers, 18-markers, 22-markers or 30-markers, the disclosed base oils desirably have less than 20 ppm and preferably less than 10 of the sum of the 16-markers, 18-markers or 22-markers, and desirably have less than 30 ppm and preferably less than 20 ppm or less than 10 ppm of the sum of the 30-markers.

The invention is further illustrated in the following non-limiting examples, in which all parts and percentages are by weight unless otherwise indicated. It should be understood however that many variations and modifications may be made while remaining within the scope of the various embodiments.

Comparative Examples 1-4

Dewaxing a Hydrotreated Deasphalted Oil (DAO) Feedstock Derived from a Semi-Naphthenic Crude Oil A DAO feedstock produced by a refinery from a semi-naphthenic crude oil was subjected to hydrotreating by contacting the DAO in the presence of hydrogen with a catalyst containing nickel-molybdenum (Ni—Mo) on alumina (hydrotreating catalyst LH-23, commercially available from Criterion Catalyst Company). The hydrotreated DAO effluent was then subjected to a $2^{nd}$ pass hydrotreating step in order to the meet the sulfur and nitrogen specifications recommended by the catalyst supplier. Table 1 below shows the DAO feedstock characteristics and those of the effluent after the $2^{nd}$ pass hydrotreating step. The $2^{nd}$ pass hydrotreating effluent was subsequently catalytically dewaxed in the presence of a dewaxing catalyst (SLD-800 commercially available from Criterion Catalyst Company) to provide four dewaxed hydrotreated DAO products. The reaction conditions and characteristics of the dewaxed hydrotreated DAO products are shown below in Table 1.

TABLE 1

Dewaxed Hydrotreated Deasphalted Oil (DAO) Characteristics

| Condition or Characteristic | Units | Feed Stock Hydrotreated DAO | Hydrotreated ($2^{nd}$ pass) Product LH23 | Dewaxed/ Hydrotreated Product (Comparative Example 1) SLD-800 | Dewaxed/ Hydrotreated Product (Comparative Example 2) SLD-800 | Dewaxed/ Hydrotreated Product (Comparative Example 3) SLD-800 | Dewaxed/ Hydrotreated Product (Comparative Example 4) SLD-800 |
|---|---|---|---|---|---|---|---|
| LHSV | $Hr^{-1}$ | | 2.2 | 2 | 2 | 1 | 0.8 |
| Pressure | kPascal | | 141855 | 141855 | 141855 | 141855 | 141855 |
| Reactor Temp | ° C. (° F.) | | 442 (715) | 335 (608) | 354 (627) | 390 (663) | 457 (730) |
| Pour Point | ° C. | 9 | 3 | 6 | 3 | 0 | −9 |
| Cloud Point | ° C. | 27 | | | | | |
| Sulfur | wt. % | 0.0191 | | | | | |
| Nitrogen | ppm | 117 | 6 | | | | |
| D7169 5% | ° C. (° F.) | 417 (782) | 352 (666) | 341 (645) | 338 (640) | 314 (598) | 211 (411) |
| Liquid Yield | | | 97% | 97% | 97% | 96% | 96% |
| Lube Yield | | | 92% | 87% | 87% | 83% | 76% |

The results in Table 1 show that despite two rounds of hydrotreating and dewaxing, obtaining a significantly reduced pour point for the semi-naphthenic crude DAO also required the use of high reaction temperatures and low LHSV rates and resulted in poor lube yields.

Example 1

Dewaxing and Hydrofinishing a Hydrotreated Deasphalted Oil (DAO) Feedstock Derived from a Semi-Naphthenic Crude Oil A DAO feedstock was subjected to two pass hydrotreating as in Comparative Examples 1-4 to provide a hydrotreated DAO effluent having the properties shown below in Table 2. The hydrotreated DAO effluent was catalytically dewaxed in the presence of two different dewaxing catalysts (HYDEX L-800 commercially available from Criterion Catalyst Company or KF-1102 commercially available from Albemarle), hydrofinished in a separate reactor in the presence of the hydrofinishing catalyst DN-200 commercially available from Criterion under the conditions shown below in Table 3, and then fractionated to provide 75-82 viscosity index bright stocks having the properties shown below in Table 4. All were produced at >95 wt. % liquid yield.

TABLE 2

Hydrotreated Deasphalted Oil (DAO) Characteristics

| Characteristic | Value |
|---|---|
| API Gravity | 23.8 |
| Sp. gr. @ 15.6/15.6° C. (60/60° F.) | 0.9109 |
| Sulfur, wt % | 0.0596 |

TABLE 2-continued

Hydrotreated Deasphalted Oil (DAO) Characteristics

| Characteristic | Value |
|---|---|
| Sulfur, ppm | 596 |
| Nitrogen (total), ppm | 571 |
| Aniline Pt., ° C. (° F.) | 123.3 (253.9) |
| RI @ 20° C. (68° F.) | 1.5007 |
| cSt.@ 38° C. (100° F.) | 1140 |
| cSt.@ 99° C. (210° F.) | 41.40 |
| SUS@38° C. (100° F.) | 5282 |
| SUS@60° C. (140° F.) | 1080 |
| SUS@99° C. (210° F.) | 195 |
| Viscosity Index 60 and 99° C. (140 and 210° F.) | 82 |
| Color ASTM | 2.5 |
| Pour Point, ° C. (° F.) | 4 (40) |
| Cloud Point, ° C. (° F.) prior to MEK dewax | 24 (76) |
| VGC | 0.814 |

TABLE 3

Dewaxing (HDW) and Hydrofinishing (HDF) Conditions

| HDW Catalyst | Clariant HYDEX-L (800 g) | Albemarle KF-1102 (800 g) |
|---|---|---|
| Pressure kPa (psig) | 12,755 (1850) | 12,755 (1850) |
| HDW LHSV ($hr^{-1}$) | 0.5 | 0.5 |
| HDF Catalyst | DN-200 (180 g) | DN-200 (180 g) |
| HDF LHSV ($hr^{-1}$) | 2.4 | 2.4 |
| Temperature Profile | Isothermal | Isothermal |

TABLE 4

Bright Stock Dewaxing Conditions and Characteristics

| Condition or Characteristic | 325A | 325B | 325C | 325D | 327A | 327B | 327C | 327D |
|---|---|---|---|---|---|---|---|---|
| Catalysts | HYDEX L/DN-200 | | | | KF-1102/DN-200 | | | |
| Reactor Temperature, ° C. (° F.) | 329 (625) | 343 (650) | 371 (700) | 329 (625) | 329 (625) | 343 (650) | 371 (700) | 329 (625) |
| Sulfur, wt. % | 0.0484 | 0.0430 | 0.0321 | 0.0521 | 0.0436 | 0.0376 | 0.0242 | 0.0485 |
| Sulfur, ppm | 484 | 430 | 321 | 521 | 436 | 376 | 242 | 485 |
| Nitrogen (total), ppm | 478 | 403 | 240 | 468 | 495 | 440 | 304 | 493 |
| Aniline Pt., ° C. (° F.) | 119.9 (247.8) | 119.9 (247.8) | 120.2 (248.4) | 121.2 (250.2) | 123.8 (254.9) | 123.4 (254.1) | 124.0 (255.2) | 124.0 (255.2) |
| cSt.@ 100° C. (210° F.) | 42.00 | 40.80 | 36.60 | 42.10 | 42.30 | 41.70 | 39.30 | 42.10 |
| Viscosity Index[1] | 82 | 80 | 80 | 82 | 82 | 81 | 79 | 80 |
| Color ASTM | 2.8 | 3.5 | 3.5 | 3.4 | 2.4 | 2.4 | 7.5 | 2.8 |
| Pour Point, ° C. (° F.) | −4 (25) | −7 (20) | −7 (20) | −7 (20) | −1 (30) | 2 (35) | −1 (30) | 2 (35) |
| Cloud Point, ° C. (° F.) prior to MEK dewax | <−60 (<−76) | <−60 (<−76) | <−60 (<−76) | <−60 (<−76) | 6 (43) | 12 (53) | 8 (46) | 8 (47) |
| VGC | 0.818 | 0.817 | 0.818 | 0.816 | 0.814 | 0.814 | 0.813 | 0.815 |

[1]60 and 99° C. (140 and 210° F.)

The results in Table 4 show that desirable cloud points and pour points were achieved at higher liquid yields, lower reactor temperatures, or both higher liquid yields and lower reactor temperatures than those employed in Comparative Examples 1-4, while using a feedstock having much higher sulfur and nitrogen contents.

Example 2

Dewaxing and Hydrofinishing a Hydrotreated Deasphalted Oil (DAO) Feedstock Derived from a Semi-Naphthenic Crude Oil Example 2 was conducted using a process like that employed in Example 1 but using a different high sulfur content DAO feedstock, a reactor temperature of 329.4° C. (625° F.), a liquid hourly space velocity of 3 $hr^{-1}$ and a pressure of 11,376 kilopascal (1,650 psi). HYDEX L-800 catalyst was employed for dewaxing, and in a separate reactor DN-3330 catalyst was employed for hydrofinishing. The properties of the DAO feedstock and the dewaxed/hydrofinished bright stock are shown below in Table 5.

TABLE 5

Feed Stock and Bright Stock Characteristics

| Characteristic | Feedstock | Product |
|---|---|---|
| API Gravity | 23.6 | 22.7 |
| Sp. gr. @ 15.6/15.6° C. (60/60° F.) | 0.91 | 0.9178 |
| Sulfur, wt. % | 0.074 | 0.0696 |
| Sulfur, ppm | 740 | 696 |
| Aniline Pt., ° C. (° F.) | 121.7 (251) | 118.0 (244.4) |
| Flash point, COC, ° C. (° F.) | 303 (577) | 320 (608) |
| UV@ 260 nm | 3.6 | 3.4 |
| RI @ 20° C. (68° F.) | 1.5016 | 1.5018 |
| cSt @40° C. (104° F.) | 900 | 899 |
| cSt @100° C. (212° F.) | 42 | 40.6 |
| SUS@38° C. (100° F.) | 4900 | 5090 |
| SUS@60° C. (140° F.) | 1100 | 1194 |
| SUS@99° C. (210° F.) | 200 | 204.7 |
| Viscosity Index | 83 | 83 |
| Color ASTM | 2.5 | 2.0 |
| Pour Point, ° C. (° F.) | 2 (35) | −6 (21) |
| Cloud Point, ° C. (° F.) | 27 (80) | −60 (−76) |
| VGC | 0.817 | 0.814 |
| Nitrogen (total) ppmw | 645 | 590 |
| TLP Yield on Feedstock | | 98.3% |
| Lube Yield on TLP | | 99.4% |
| Lube Yield on Feedstock | | 97.7% |
| Hydrogen Consumption (SCF/BBL) | | 67.7 |

The results in Table 5 show that desirable cloud points and pour points were achieved without adversely affecting yield, at a low reactor temperature, and while using a high sulfur content, high nitrogen content feedstock. Other important lubricant properties such as aniline point, flash point, refractive index and viscosity index were unchanged, little changed or not adversely changed compared to the feedstock.

Example 3

Dewaxing and Hydrofinishing a Hydrotreated Deasphalted Oil (DAO) Feedstock Derived from a Semi-Naphthenic Crude Oil Example 3 was conducted using a process like that employed in Example 1 but using a different high sulfur content DAO feedstock, a reactor temperature of 329° C., a liquid hourly space velocity of 1.5 $hr^{-1}$ and a pressure of 11,376 kilopascal (1,650 psi). HYDEX L-800 catalyst was employed for dewaxing, and in a separate reactor DN-3330 catalyst was employed for hydrofinishing. The properties of the DAO feedstock and the dewaxed/hydrofinished bright stock are shown below in Table 6.

TABLE 6

Feed Stock and Bright Stock Characteristics

| Characteristic | Feedstock | Product |
|---|---|---|
| API Gravity | 23.7 | 23.8 |
| Sp. gr. @ 15.6/15.6° C. (60/60° F.) | 0.9116 | 0.9112 |
| Sulfur, wt. % | 0.088 | 0.0525 |
| Sulfur, ppm | 880 | 525 |
| Aniline Pt., ° C. (° F.) | 121.1 (249.9) | 122.1 (251.7) |
| Flash point, COC, ° C. (° F.) | 291 (555) | 310 (590) |
| UV@ 260 nm | 3.4 | 2.3 |
| RI @ 20° C. (68° F.) | 1.5019 | 1.5001 |
| cSt @40° C. (104° F.) | 887 | 901 |
| cSt @100° C. (212° F.) | 41.9 | 41.4 |
| SUS@38° C. (100° F.) | 4847 | 4934 |
| SUS@60° C. (140° F.) | 1140 | 1142 |
| SUS@99° C. (210° F.) | 204.5 | 202.0 |
| Viscosity Index | 84 | 82 |
| Color ASTM | 2.3 | 2.5 |
| Pour Point, ° C. (° F.) | −3 (26) | −7 (19) |
| Cloud Point, ° C. (° F.) | 8 (46) | −1 (30) |
| VGC | 0.816 | 0.815 |
| Nitrogen (total) ppmw | 645 | 605 |
| PAH 8-Markers, ppm | 0.9 | 0.1 |
| IP 346, wt. % | 1.2 | 0.8 |
| Lube Yield on Total Liquid Product | | 99.6% |

The results in Table 6 show that desirable cloud points and pour points were achieved without adversely affecting yield, at a low reactor temperature, and while using a high sulfur content feedstock. Other important lubricant properties such as aniline point, flash point, refractive index and viscosity index were unchanged, little changed or not adversely changed compared to the feedstock.

Example 4

30-Marker, 18-Marker and 8-Marker Testing

Using the method of Example 3, a high sulfur content DAO feedstock was dewaxed and hydrofinished, using an initial dewaxing reactor temperature of 343° C. (650° F.), a liquid hourly space velocity of 1.5 $hr^{-1}$ and a pressure of 11,376 kilopascal (1,650 psi) and a hydrofinishing reactor temperature of 302° C. (575° F.), a liquid hourly space velocity of 2.0 $hr^{-1}$ and a pressure of 11,376 kilopascal (1,650 psi). To compensate for gradual degradation of the dewaxing catalyst, the dewaxing reactor temperature was increased by about 6° C. (10° F.) per week so as to obtain a haze free product with a reduced pour point, ending at 357° C. (675° F.) two and one-half weeks later. Product samples were periodically withdrawn and combined for analysis. The properties of the dewaxed/hydrofinished bright stock are shown below in Table 7.

TABLE 7

Bright Stock Characteristics

| Characteristic | Product |
|---|---|
| API Gravity | 23.4 |
| Sp. gr. @ 15.6/15.6° C. (60/60° F.) | 0.9133 |
| Sulfur, wt. % | 0.060 |
| Sulfur, ppm | 597 |

TABLE 7-continued

| Bright Stock Characteristics | |
|---|---|
| Characteristic | Product |
| Aniline Pt., ° C. (° F.) | 122.1 (251.7) |
| Flash point, COC, ° C. (° F.) | 299 (570) |
| UV@ 260 nm | 2.6 |
| RI @ 20° C. (68° F.) | 1.5014 |
| cSt @40° C. (104° F.) | 971 |
| cSt @100° C. (212° F.) | 43.1 |
| SUS@38° C. (100° F.) | 5329 |
| SUS@99° C. (210° F.) | 210 |
| Viscosity Index | 81 |
| Color ASTM | 1.5 |
| Pour Point, ° C. (° F.) | −11 (12) |
| Cloud Point, ° C. (° F.) | 1.1 (34) |
| VGC | 0.817 |
| Nitrogen (total) ppmw | 518 |
| IP 346, wt. % | 0.64 |

The bright stock product was evaluated for PAH levels to determine 30-markers, 22-markers, 18 markers, 16-markers and 8-markers levels in ppm. The results are shown below in Table 8.

TABLE 8

| PAH Levels | | | | | |
|---|---|---|---|---|---|
| 30-Marker PAH | 22-Marker PAH? | 18-Marker PAH? | 16-Marker PAH? | 8-Marker PAH? | Level, ppm |
| Acenaphthene | Yes | Yes | Yes | | 0.038 |
| Acenaphthylene | Yes | Yes | Yes | | 0 |
| Anthanthrene | | | | | 0.005 |
| Anthracene | Yes | Yes | Yes | | 0.01 |
| Benzo(a)anthracene | Yes | Yes | Yes | Yes | Not Detected |
| Benzo(a)pyrene | Yes | Yes | Yes | Yes | 0.002 |
| Benzo(b)fluoranthene | Yes | Yes | Yes | Yes | 0.003 |
| Benzo(b)naphtho[1,2-d] thiophene | | | | | 0.023 |
| Benzo(e)pyrene | Yes | Yes | | Yes | 0.043 |
| Benzo(ghi)fluoranthene | | | | | 0 |
| Benzo(ghi)perylene | Yes | Yes | Yes | | 0.217 |
| Benzo(j)fluoranthene | Yes | Yes | | Yes | 0.002 |
| Benzo(k)fluoranthene | Yes | Yes | Yes | Yes | 0.002 |
| Benzo[c]phenanthrene | | | | | 0.002 |
| Chrysene | Yes | Yes | Yes | Yes | 0.013 |
| Coronene | | | | | 1.48 |
| Cyclopenta(c,d)pyrene | | | | | 0.001 |
| Dibenzo(a,e)pyrene | Yes | | | | 0.004 |
| Dibenzo(a,h)anthracene | Yes | Yes | Yes | Yes | 0 |
| Dibenzo(a,h)pyrene | Yes | | | | 0 |
| Dibenzo(a,i)pyrene | Yes | | | | 0.005 |
| Dibenzo(a,l)pyrene | Yes | | | | 0.006 |
| Fluoranthene | Yes | Yes | Yes | | 0 |
| Fluorene | Yes | Yes | Yes | | 0.216 |
| Indeno[123-cd]pyrene | Yes | Yes | Yes | | Not Detected |
| Naphthalene | Yes | Yes | Yes | | 0.11 |
| Perylene | | | | | Not Detected |
| Phenanthrene | | Yes | | | 0.023 |
| Pyrene | | Yes | | | 0.054 |
| Triphenylene | | | | | 0.009 |
| Total 30-Markers, ppm | | | | | 2.27 |
| Total 22-Markers, ppm | | | | | 0.75 |
| Total 18-Markers, ppm | | | | | 0.73 |
| Total 16-Markers, ppm | | | | | 0.69 |
| Total 8-Markers, ppm | | | | | 0.07 |

The results in Table 8 show that very low 8-markers, 16-markers, 18-markers, 22-markers and 30-markers levels were obtained. The use in the hydrofinishing step of a lower reactor temperature and higher liquid hourly space velocity compared to the reactor temperature and liquid hourly space velocity used for the dewaxing step is believed to have contributed to the very favorable 8-markers, 16-markers, 18-markers, 22-markers and 30-markers results.

The above description is directed to the disclosed processes and is not intended to limit them. Those of skill in the art will readily appreciate that the teachings found herein may be applied to yet other embodiments within the scope of the attached claims. The complete disclosure of all cited patents, patent documents, and publications are incorporated herein by reference as if individually incorporated. However, in case of any inconsistencies the present disclosure, including any definitions herein, will prevail.

We claim:

1. A process for producing a naphthenic bright stock comprising the steps of:

a) dewaxing a naphthenic oil feedstock having a sulfur content of about 0.01 up to about 0.5% by weight (as measured by ASTM D4294) and a nitrogen content of about 0.01 up to about 0.1% by weight (as measured by ASTM D5762) in the presence of a dewaxing cracking catalyst and under catalytic dewaxing conditions to produce a dewaxed naphthenic effluent, wherein the dewaxing conditions comprise a temperature from about 287° C. to about 371° C., a pressure from about 5,515 kPa to about 22,063 kPa, and a liquid hourly space velocity from about 1 $hr^{-1}$ to about 5 $hr^{-1}$;

b) hydrofinishing the dewaxed naphthenic effluent to produce a dewaxed hydrofinished naphthenic effluent having reduced levels of polycyclic aromatic hydrocarbon compounds and reduced levels of unstable olefinic compounds; and c) fractionating the dewaxed hydrofinished naphthenic effluent to separate the dewaxed hydrofinished naphthenic effluent into one or more gaseous fractions and one or more liquid fractions and to provide a naphthenic bright stock having a pour point (as measured by ASTM D5949) reduced by 10° C. compared to that of the naphthenic oil feedstock, at a yield greater than 85% of total naphthenic bright stock over total naphthenic oil feedstock.

2. The process of claim 1, wherein the naphthenic oil feedstock comprises hydrotreated deasphalted naphthenic crude, hydrotreated deasphalted waxy naphthenic crude, hydrotreated deasphalted naphthenic distillate or a mixture thereof.

3. The process of claim 1, wherein the naphthenic oil feedstock comprises a blend of hydrotreated deasphalted naphthenic crude, hydrotreated deasphalted waxy naphthenic crude, or a hydrotreated deasphalted naphthenic distillate with paraffinic feedstock, paraffinic distillate, light or heavy cycle oil, deasphalted oil, cracker residue, hydrocarbon feedstock containing heteroatom species and aromatics and boiling at about 150° C. to about 550° C. (as measured by ASTM D7169), or mixture thereof.

4. The process of claim 1, wherein the naphthenic oil feedstock is prepared from a naphthenic feedstock having a sulfur content up to about 5% by weight (as measured by ASTM D4294) and a nitrogen content up to about 3% by weight (as measured by ASTM D5762).

5. The process of claim 1, wherein the naphthenic oil feedstock contains about 0.01 up to about 0.15 wt. % sulfur.

6. The process of claim 1, wherein the naphthenic oil feedstock has a pour point at least 100° C. greater than the dewaxed naphthenic effluent or a cloud point at least 10° C. greater than the dewaxed naphthenic effluent.

7. The process of claim 1, wherein the dewaxing catalyst is chosen from a molecular sieve zeolite having a 10-membered oxygen ring, a mordenite framework inverted zeolite, and a ZSM-5 catalyst.

8. The process of claim 1, wherein the dewaxing catalyst is a bifunctional catalyst having both a dewaxing function and a hydrogenation function.

9. The process of claim 1, wherein the dewaxing conditions comprise a temperature from about 301° C. to about 343° C., a pressure from about 8,273 kPa to about 20,684 kPa, and a liquid hourly space velocity from about 1.5 $hr^{-1}$ to about 2 $hr^{-1}$.

10. The process of claim 1, wherein the hydrofinishing conditions comprise a temperature from about to 260° C. to about 399° C., a pressure from to about 5,515 kPa to about 27,579 kPa, and a liquid hourly space velocity from about 0.25 $hr^{-1}$ to about 5 $hr^{-1}$.

11. The process of claim 1, wherein the dewaxing step is carried out in a different reactor than the hydrofinishing step.

12. The process of claim 1, wherein the hydrofinishing step uses a lower reactor temperature and higher liquid hourly space velocity compared to the reactor temperature and liquid hourly space velocity used for the dewaxing step.

13. The process of claim 1, wherein the naphthenic bright stock has an aniline point (ASTM D611) about 100° C. to about 140° C. and a flash point (Cleveland Open Cup, ASTM D92) about 188° C. to about 409° C.

14. The process of claim 1, wherein the naphthenic bright stock has a viscosity index (VI) greater than 75, a viscosity (SUS at 98.9° C.) of about 165 to about 250, and a pour point (° C., ASTM D5950) of about 42° C. to about −39° C.

15. The process of claim 1, wherein the yield is greater than about 97%.

16. The process of claim 1, wherein the naphthenic bright stock contains no more than 10 ppm total polycyclic aromatic hydrocarbon 8-markers and no more than 1 ppm benzo[a]pyrene as evaluated using European standard EN 16143:2013.

17. The process of claim 1, wherein the naphthenic bright stock contains no more than 1 ppm total polycyclic aromatic hydrocarbon 8-markers.

18. The process of claim 1, wherein the naphthenic bright stock contains no more than 20 ppm total of the polycyclic aromatic hydrocarbon compounds acenaphthene, acenaphthylene, anthracene, benzo(a)anthracene, benzo(a)pyrene, benzo(b)fluoranthene, benzo(e)pyrene, benzo(ghi)perylene, benzo(j)fluoranthene, benzo(k)fluoranthene, chrysene, dibenzo(a,h)anthracene, fluoranthene, fluorene, indeno[123-cd]pyrene, naphthalene, phenanthrene and pyrene.

19. The process of claim 1, wherein the naphthenic bright stock contains no more than 10 ppm total of the polycyclic aromatic hydrocarbon compounds.

20. The process of claim 1, wherein the naphthenic bright stock contains no more than 10 ppm total of the polycyclic aromatic hydrocarbon compounds acenaphthene, acenaphthylene, anthanthrene, anthracene, benzo(a)anthracene, benzo(b)fluoranthene, benzo(b)naphtho[1,2-d]thiophene, benzo(e)pyrene, benzo(ghi)fluoranthene, benzo(ghi)perylene, benzo(j)fluoranthene, benzo(k)fluoranthene, benzo[c]phenanthrene, chrysene, coronene, cyclopenta(c,d)pyrene, dibenzo(a,e)pyrene, dibenzo(a,h)anthracene, dibenzo(a,h)pyrene, dibenzo(a,i)pyrene, dibenzo(a,l)pyrene, fluoranthene, fluorene, indeno[123-cd]pyrene, naphthalene, perylene, phenanthrene, pyrene and triphenylene and no more than 1 ppm benzo[a]pyrene as evaluated using European standard EN 16143:2013.

21. The process of claim 1, further comprising the step of hydrotreating a deasphalted naphthenic oil by contacting the deasphalted naphthenic oil with a hydrotreating catalyst in the presence of hydrogen under hydrotreating conditions to provide the naphthenic feedstock oil having a sulfur content of about 0.01 up to about 0.5% by weight (as measured by ASTM D4294) and a nitrogen content of about 0.01 up to about 0.1% by weight (as measured by ASTM D5762).

22. The process of claim 21, further comprising the step of deasphalting a naphthenic feedstock having a sulfur content up to about 5% by weight (as measured by ASTM D4294) and a nitrogen content up to about 3% by weight (as measured by ASTM D5762) to separate the deasphalted naphthenic oil from an asphalt and resins fraction.

* * * * *